US006139258A

United States Patent [19]

Lang, III et al.

[11] Patent Number: 6,139,258

[45] Date of Patent: Oct. 31, 2000

[54] AIRFOILS WITH LEADING EDGE POCKETS FOR REDUCED HEAT TRANSFER

[75] Inventors: William F. Lang, III, Chula Vista, Calif.; Thomas Alvin Auxier, Lake Park, Fla.

[73] Assignee: United Technologies Corporation, Hartford, Conn.

[21] Appl. No.: 07/031,966

[22] Filed: Mar. 30, 1987

[51] Int. Cl.[7] ..... F04D 31/00

[52] U.S. Cl. ..... 415/116; 415/115

[58] Field of Search ..... 415/116, 115; 416/97 R, 97 A, 95; 60/757, 752, 755, 756, 758–760

[56] References Cited

U.S. PATENT DOCUMENTS

| | | | |
|---|---|---|---|
| 4,601,638 | 7/1986 | Hill | 415/115 |
| 4,653,983 | 3/1987 | Vehr | 415/115 |
| 4,664,597 | 5/1987 | Auxier | 415/115 |
| 4,669,957 | 6/1987 | Phillips | 415/115 |
| 4,676,719 | 6/1987 | Auxier | 415/115 |
| 4,684,323 | 8/1987 | Field | 415/115 |
| 4,705,455 | 11/1987 | Sahm | 415/115 |

*Primary Examiner*—Charles T. Jordan
*Assistant Examiner*—Denise J. Buckley

[57] ABSTRACT

A gas turbine engine airfoil leading edge includes depressions therein longitudinally spaced apart and centered on stagnation points. The depressions stay filled with relatively stationary air during engine operation and reduce the heat load at the leading edge, which is primarily cooled by an internal supply of cooling fluid.

11 Claims, 2 Drawing Sheets

FIG. 2
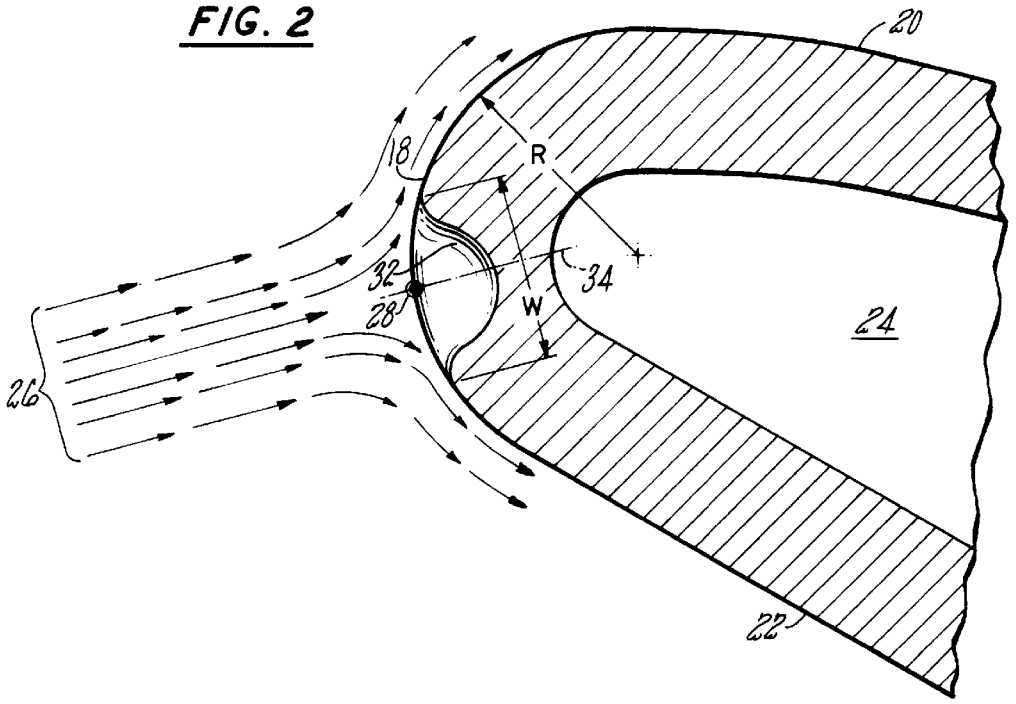
FIG. 3a
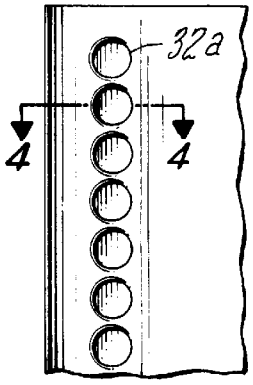
FIG. 3b
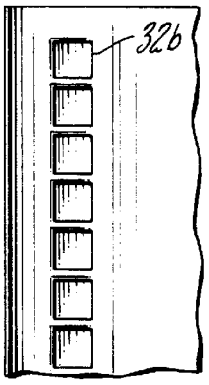
FIG. 3c
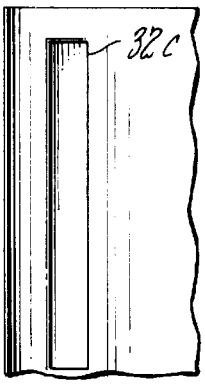
FIG. 3d
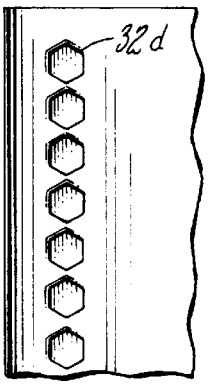
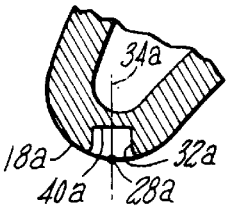
FIG. 4

AIRFOILS WITH LEADING EDGE POCKETS FOR REDUCED HEAT TRANSFER

TECHNICAL FIELD

This invention relates to airfoils adapted to operate in a hot environment.

BACKGROUND ART

Techniques for cooling airfoils used in hot environments, such as the turbine section of a gas turbine engine, are continuously being developed. In extremely hot environments the airfoils are made hollow; and a cooling fluid is passed therethrough to keep the metal temperature within acceptable limits. In a gas turbine engine the air for cooling turbine stators and rotors is typically bled from the compressor flow path, routed around the burner section, and directed into the hollow airfoils of the turbine section. The cooling fluid is ejected through the trailing edge of the airfoil, and often through small holes or slots in the pressure and suction sidewalls and through the leading edge.

It is desirable to use as little cooling air as possible, since air used for cooling is air which could otherwise be used as the working fluid medium to produce thrust. Most cooling techniques try to maximize the amount of cooling accomplished by each unit mass of cooling fluid. Techniques for reducing the heat load on the airfoil itself without using cooling fluid in the process would be highly desirable and could reduce the amount of cooling fluid needed to achieve an acceptable metal temperature or could allow the airfoil to operate in a hotter environment using the same amount of cooling fluid.

DISCLOSURE OF INVENTION

One object of the present invention is an airfoil construction which reduces the heat load on the leading edge of the airfoil without the use of additional cooling fluid.

According to the present invention an airfoil shaped article having internal cooling proximate its leading edge has at least one depression formed in its leading edge defining a pocket of relatively stationary fluid which acts as an insulating layer between a hot external fluid and the article.

The fluid approaching the leading edge of an airfoil is divided between the pressure and suction sides of the airfoil. At any transverse cross section taken through the airfoil there is a fluid streamline located precisely where the fluid divides. The velocity of the fluid along that streamline is reduced to zero at the leading edge.

Theoretically, full pressure recovery occurs at this point of zero velocity. The pressure at this point is called the stagnation pressure. The point at which this occurs is called the stagnation point and is on the leading edge of the airfoil. There is a stagnation point at every longitudinal station along the leading edge of the airfoil.

The precise location of each stagnation point along the length of the leading edge depends upon the relative angle of incidence of the fluid against the leading edge. For stators, this depends only upon the direction of fluid flow. For rotors, the rotational velocity of the airfoil and the fluid velocity must also be taken into account. Given the curvature of the leading edge, the approaching fluid direction and velocity, and the rotational speed of the airfoil (if any), the location of the stagnation points along the leading edge can be readily determined by means well-known in the art.

The depression should be located such that the stagnation point is within the boundary formed by the rim of the depression. If the stagnation points along the leading edge are connected, they form a stagnation line. The depressions are preferably centered along the stagnation line. The fluid within the depressions remains relatively stationary compared to the free stream velocity and acts as an insulating layer between the hot free stream fluid and the body of the article, thereby reducing heat load and airfoil metal temperatures at the leading edge. In a gas turbine engine, rotor speeds and fluid velocities vary depending upon engine operating conditions, and the stagnation point at a particular cross section will move depending upon such engine operating condition. Preferably the depressions are located where the stagnation points would be located under the largest heat load operating condition, which is usually the airfoil life-limiting condition. Even if the stagnation points or the stagnation line move somewhat under varying engine operating conditions, as long as they stay within the transverse width of the depression, some benefits from the present invention should accrue.

The precise shape of the depressions is not thought to be critical. For example, the epressions may be hemispheric-like in shape or cylinder-like. They may also be elongated along the length of the leading edge, such as slot-like.

The foregoing and other features and advantages of the present invention will become more apparent from the following description and accompanying drawings.

BRIEF DESCRIPTION OF THE DRAWING

FIG. 2 is a sectional view taken along the line 2—2 of FIG. 1.

FIGS. 3(*a*)–3(*d*) show alternate constructions for the present invention.

FIG. 4 is a sectional view taken along the line 4—4 of FIG. 3(*a*).

BEST MODE FOR CARRYING OUT THE INVENTION

Figure 1:
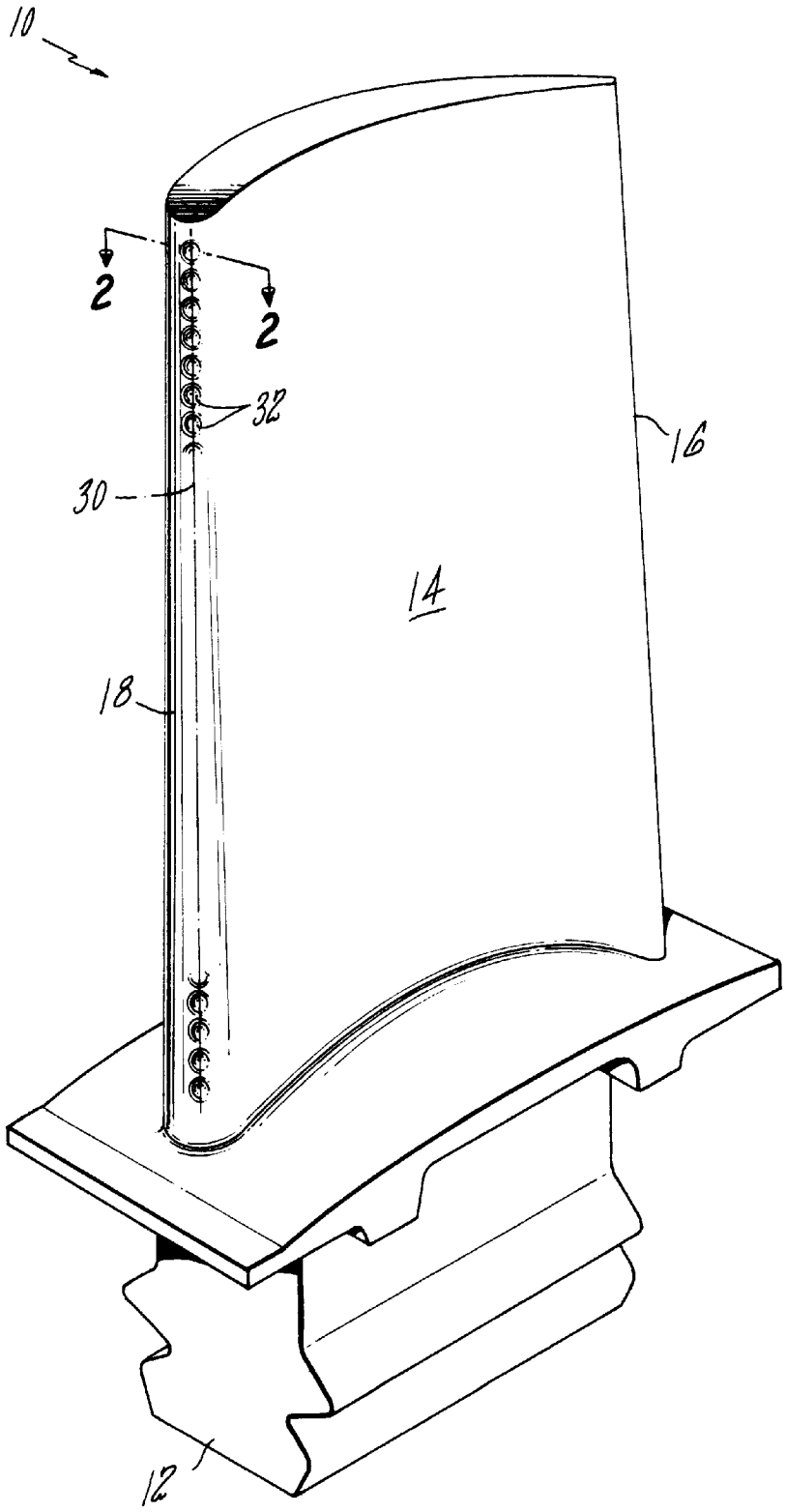
FIG. 1 is a perspective view of a gas turbine engine rotor blade incorporating the features of the present invention.

As an exemplary embodiment of the present invention, consider the gas turbine engine turbine rotor blade of FIG. 1, generally represented by the reference numeral 10. The blade comprises a root portion 12 and an airfoil 14. The airfoil 14 comprises a trailing edge 16 and a leading edge 18. As best shown in FIG. 2, the leading edge 18 has a smoothly curved contour which blends with the suction surface 20 of the airfoil and the pressure surface 22 of the airfoil. In this embodiment the leading edge 18 is a circular arc having a radius R which is constant over the length of the airfoil, although, for purposes of the present invention, it need not be constant. Also, in this embodiment, the airfoil 14 is hollow, having a cooling cavity 24 running the longitudinal length of the airfoil proximate the leading edge 18. Cooling air within the cavity 24 provides convective cooling of the leading edge material.

Streamlines of the hot fluid medium within the gas path are represented by the arrows 26 in FIG. 2. These arrows show the direction of streamline flow relative to the airfoil 16 which, of course, is moving during engine operation. At the stagation point 28 the flow divides between the suction surface 20 and the pressure surface 22. There is a stagnation point at every cross section along the longitudinal length of the airfoil leading edge. In this embodiment these stagnation points form a straight line ("stagnation" line) represented by the line 30 in FIG. 1; however, the stagnation line 30 will not necessarily be straight for every airfoil. Airfoils with twist at their leading edge will have a stagnation line which follows such twist.

Formed in the leading edge 18 are a plurality of longitudinally spaced apart depressions 32, each being centered approximately on an extension of the streamline which intersects the stagnation point. In this embodiment the depressions 32 are hemispheric-like in shape, being approximately axisymmetric about a line 34 which is an extension of the streamline passing through the stagnation point 28.

In certain applications, such as for rotating airfoils, the stagnation points are not fixed. Their location depends upon engine operating parameters, such as rotor speed. For those applications the depressions are located at the expected stagnation points for a preselected operating condition, generally the condition which is life-limiting, so as to obtain the maximum benefit from the invention.

In operation, the hot fluid or working medium within the depressions 32 tends to remain relatively stationary therewithin. By "relatively stationary" it is meant that fluid velocities within the depressions 32 are low relative to the freestream velocity. The depressions 32 therefore contain pockets of relatively stationary fluid which act as insulating layers, thereby reducing leading edge heat load. The metal temperature adjacent these depressions stays cooler, and less work is required of the internal cooling fluid.

The most suitable width W of the depressions transverse to the longitudinal direction, as well as their depth, should be determined by experimentation and stress analysis for each application. Operating conditions, metal composition, and airfoil wall thicknesses are all factors which may impact the selection of the size and shape of the depressions and the spacing between depressions.

FIG. 3 shows alternate shapes for the depressions 32 of the present invention. FIG. 4 shows the depressions 32(*a*) of FIG. 3(*a*) in cross section. Cross-sectional views of the depressions 32(*b*), 32(*c*) and 32(*d*) are not shown since they would be identical in appearance to the cross-sectional shape of the depression 32(*a*). Note that the depressions 32(*a*) are cylindrical in shape, with the bottom or end 40 of the cylinder being perpendicular to the extension 34(*a*) of the streamline passing through the stagnation point 28(*a*). The depressions 32(*b*) and 32(*d*) are also cylinder-like in shape.

The depression 32(*c*) is an elongated slot. Elongated slots are not preferred since it is more difficult to keep fluids within such slots relatively stationary due to radial pressure gradients.

Although this invention has been shown and described with respect to detailed embodiments thereof, it will be understood by those skilled in the art that various changes in form and detail thereof may be made without departing from the spirit and scope of the claimed invention.

What is claimed is:

1. An airfoil shaped article having a longitudinally extending leading edge and adapted to be disposed in a hot fluid medium flowing downstream relative thereto toward said leading edge, said article having a cooling fluid cavity therewithin proximate said leading edge for providing convective cooling of said leading edge, at least one depression formed in said leading edge defining a pocket of relatively stationary fluid therein for providing an insulating fluid layer between the hot flowing fluid and the article to reduce heat load at the leading edge.

2. The article according to claim 1, comprising a plurality of said depressions spaced apart longitudinally along said leading edge.

3. The article according to claim 2, wherein said depressions are located at expected stagnation points along said leading edge.

4. An airfoil adapted for use in a gas turbine engine, said airfoil having a pressure surface, a suction surface, and a smoothly curved longitudinally extending leading edge blending with said pressure and suction surfaces, said airfoil having a cooling fluid cavity therewithin proximate said leading edge for providing convective cooling of said leading edge, said airfoil adapted to be disposed in a hot fluid medium flowing downstream relative thereto toward said leading edge, at least one depression formed in said leading edge defining a pocket of relatively stationary fluid therein for providing an insulating fluid layer between the hot flowing fluid and the article to reduce heat load at the leading edge.

5. The airfoil according to claim 4, including a plurality of said depressions longitudinally spaced apart along said leading edge.

6. The airfoil according to claim 4, wherein said at least one depression is elongated in the longitudinal direction.

7. The airfoil according to claim 5 wherein said depressions are located along said leading edge at the location of the stagnation points at a preselected engine operating condition.

8. The airfoil according to claim 7, wherein said depressions are hemispheric-like in shape.

9. The airfoil according to claim 7 wherein said depressions are cylinder-like in shape.

10. The airfoil according to claim 7 wherein each depression is centered on an extension of the streamline which would intersect the stagnation point on the leading edge at the preselected operating condition.

11. The airfoil according to claim 10 wherein said depressions are cylinder-like in shape and have a bottom surface substantially perpendicular to said streamline.

* * * * *